United States Patent [19]

Miyamoto et al.

[11] 4,254,612

[45] Mar. 10, 1981

[54] DEVICE FOR PREVENTING THE ACCUMULATION OF FIBERS IN AN OPEN-END SPINNING FRAME

[75] Inventors: Noriaki Miyamoto; Masao Shiraki, both of Kariya; Kinpei Mitsuya, Aichi, all of Japan

[73] Assignee: Kabushiki Kaisha Toyoda Jidoshokki Seisakusho, Aichi, Japan

[21] Appl. No.: 82,723

[22] Filed: Oct. 9, 1979

[30] Foreign Application Priority Data

Oct. 13, 1978 [JP] Japan ..... 53/141039[U]
Oct. 16, 1978 [JP] Japan ..... 53/141756[U]

[51] Int. Cl.[3] ..... D01H 7/895
[52] U.S. Cl. ..... 57/58.95; 57/58.91
[58] Field of Search ..... 57/58.89, 58.95; 19/105

[56] References Cited

U.S. PATENT DOCUMENTS

| | | | |
|---|---|---|---|
| 3,571,859 | 3/1971 | Dodlebsky et al. | 57/58.91 X |
| 3,624,997 | 12/1971 | Didek et al. | 57/58.95 X |
| 3,626,681 | 12/1971 | Naruse | 57/58.95 X |
| 3,828,539 | 8/1974 | Croasdale et al. | 57/58.91 |
| 3,938,310 | 2/1976 | Didek et al. | 57/58.95 X |
| 3,974,635 | 8/1976 | Morikawa et al. | 57/58.95 |
| 4,067,182 | 1/1978 | Jaros et al. | 57/58.95 |

*Primary Examiner*—Donald Watkins
*Attorney, Agent, or Firm*—Burgess, Ryan and Wayne

[57] ABSTRACT

An open-end spinning frame comprises a fiber feeding mechanism, constructed with a feed foller and a presser urged towards the feed roller, a combing roller having a metallic wire wound therearound, a rotor for spinning the fibers delivered from the combing roller, and a pair of flat side plates. The feeding mechanism is provided with a passage for flowing air current, which passage is formed by chamfering the side of the presser, by shortening the width of the feed roller or by forming only one projection at the front end of the presser. Through the air current flowing passage, one or more flow-in air currents flow so that the accumulation of fibers does not occur easily.

6 Claims, 13 Drawing Figures

DEVICE FOR PREVENTING THE ACCUMULATION OF FIBERS IN AN OPEN-END SPINNING FRAME

TECHNICAL FIELD TO WHICH THE INVENTION RELATES

The present invention relates to an open-end spinning frame and, more specifically, to a device for preventing the accumulation of fibers in an open-end spinning frame. The present invention, more particularly, relates to a device for preventing fibers or flies, which are scattered from a combing roller in an open-end spinning frame, from accumulating in the region neighboring the upper and lower surfaces of a fiber feeding mechanism which is constructed with a feed roller for feeding fibers to the combing roller and a presser urged toward the feed roller.

BACKGROUND ART OF THE INVENTION

In an open-end spinning frame, the accumulation of fibers may prevent the smooth spinning operation and may cause yarn breakage and defective spun yarn. Therefore, it is advantageous to prevent such an accumulation of fibers. It is generally observed that when the spinning speed in an open-end frame is increased, the accumulation of fibers in the region neighboring the upper and lower surfaces of a fiber feeding mechanism is greater.

A device for preventing the accumulation of fibers in an open-end spinning frame is disclosed in U.S. Pat. No. 3,922,839. The device is intended to prevent the accumulation of fibers in the space between the free lateral surfaces of the feed roller and the combing roller and the inner surface of the closure plate covering the feed roller and combing roller in an open-end spinning frame. A groove is formed on the inner surface of the closure plate extending in opposition to at least the free lateral surfaces of the feed roller and combing roller, and one end of the groove is connected to an air suction source, which is either a channel for feeding combed fibers to the rotary spinning chamber, or a duct which discharges the air exhausted from the rotary spinning chamber. However, such an open-end spinning frame has the following disadvantages. Fibers which pass through the groove may stick at the portion adjacent to the side surface of the combing roller because of the rotational movement of the combing roller, and as a result, an accumulation of fibers may occur. Since part of the fibers pass by the combing roller without being subjected to a combing operation and are delivered to the spinning rotor, a yarn breakage or a defective spun yarn may result when a mass of fibers passing by the combing roller is delivered to the spinning rotor.

SUMMARY OF THE INVENTION

An object of the present invention is to provide a device which prevents the accumulation of fibers in an open-end spinning frame and which combs all fibers, in other words, a device in which no fibers can pass by the combing roller without being subjected to any combing operation.

The object of the present invention is accomplished by an open-end spinning frame which comprises a fiber feeding mechanism including a feed roller and a presser urged towards the feed roller, a combing roller for combing fibers fed from the feed roller, a rotor for spinning the fibers delivered from the combing roller, and a pair of flat side plates disposed at the sides of the feed roller, the presser and the combing roller. The feeding mechanism is provided at a widthwise side region thereof with a passage for flow of an air current which prevents the accumulation of fibers therearound and which assists the combing operation of the fibers passing through the passage.

In an embodiment of the present invention, the front side of the presser is chamfered so that the front width of the presser is smaller than that of the combing roller so that the chamfered portion of the presser forms the air current flowing passage.

In another embodiment of the present invention, the width of the feed roller is smaller than that of the combing roller so that the air current flowing passage is formed between the side of the feed roller and the corresponding flat side plate.

In a further embodiment of the present invention, the front of the presser has one projection, and the front end of the projection is near the combing roller, so that a space is formed between the front of the presser, the projection and the combing roller, which space serves as the air current flow passage.

BRIEF DESCRIPTION OF THE DRAWINGS

Some embodiments of the present invention will now be explained with reference to the accompanying drawings, wherein.

DETAILED DESCRIPTION OF THE INVENTION

Figure 1:
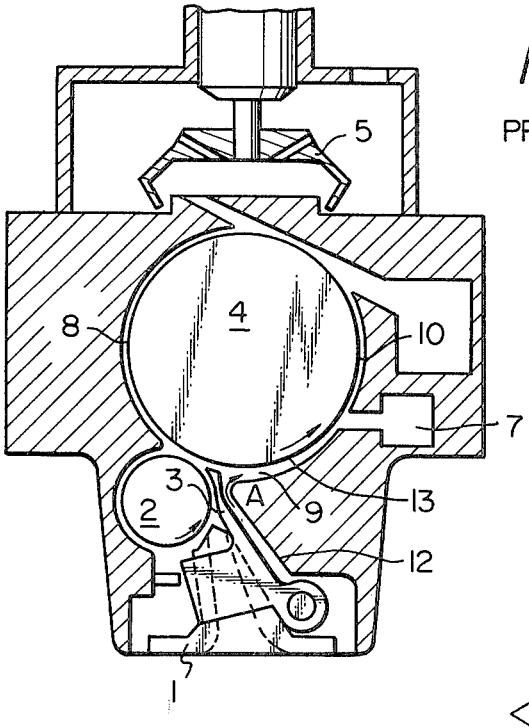
Fig. 1 PRIOR ART
FIG. 1 is a cross sectional plan view of a conventional open-end spinning frame.

A conventionally known open-end spinning frame will now be explained with reference to FIG. 1. In the open-end spinning frame illustrated in FIG. 1, a sliver introduced from a collector 1 is delivered to a combing roller 4 which rotates counterclockwise. While the sliver is delivered, it is held by the fiber feeding mechanism. The mechanism is constructed with a feed roller 2 which is also rotatable in a counterclockwise direction and a presser 3 which is urged towards the feed roller 2. The sliver is then fed into a rotor 5 which rotates at a high speed and a spun yarn is formed while it is taken up from the rotor 5. In such an open-end spinning frame, the combing roller 4 rotates at a speed of several thousand revolutions per minute so that a metallic wire wound therearound effects the combing operation to the fed fibers, and as a result, short fibers, dust and impurities contained within the fed fibers are scattered. Some of the short fibers and so on, which will hereinafter be referred to as "flies," may be discharged into a dust removing chamber 7 or fed into the inside of the rotor 5. However, many flies are discharged around the combing roller 4, especially at the narrow return passage 8 and on the lateral surfaces of the combing roller 4, because of the centrifugal force acting upon the flies when they are in a relatively large space adjacent to the fiber feeding mechanism. Thus, the discharged fibers may be accumulated on the combing roller 4.

Within the rotor 5, a vacuum is created because of the rotation of the rotor 5, and the vacuum facilitates the flow of the air thereinto. Also, within the fiber feeding mechanism, a flow-in air current A which flows into both a combing region 9 and a transferring region 10, is created by means of the air flowing into the rotor together with an air flow caused by the rotation of the combing roller 4. Accordingly, part of the flies are conveyed to the combing region 9 and the transferring region 10 by means of the flow-in air current A, but they are not accumulated on the fiber feeding mechanism.

When flies accumulate in the space adjacent to the fiber feeding mechanism, the operations of the feed roller 2 and the presser 3 become inefficient. After the flies are gathered together to form a mass of a certain size or after the flies are solidified, if they are delivered into the spinning rotor by means of the operation of the combing roller 4 or the flow-in air current A a yarn breakage may occur, or the yarn quality may be inferior.

The inventors of the present invention focused on the flow-in air current A which is created in a portion of the fiber feeding mechanism. To prevent the accumulation of flies or fibers within the fiber feeding mechanism, in the present invention, a specially designed construction is utilized so that a large amount of flowing air current, which is similar to the flow-in air current A, is created in a wide region and so that the movement of the flies is increased.

Figure 2:
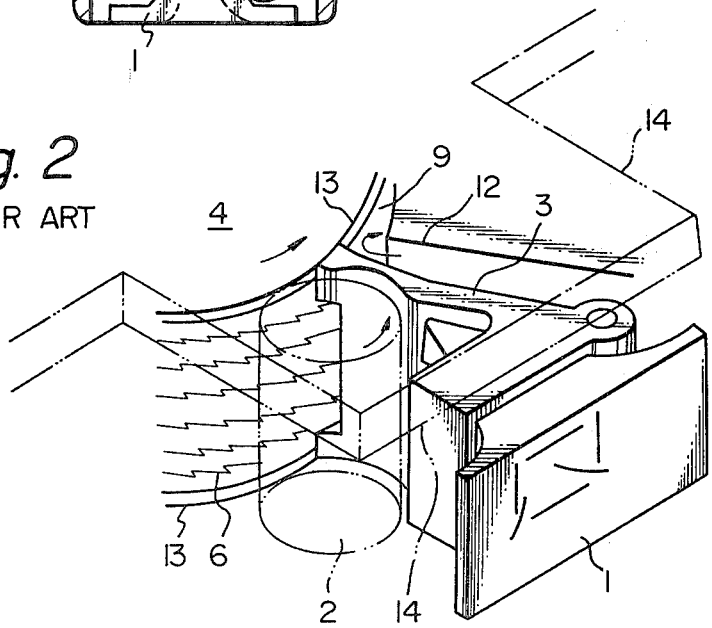
Fig. 2 PRIOR ART
FIG. 2 is a partial perspective view of the conventional fiber feeding mechanism illustrated in FIG.1.
Figure 3:
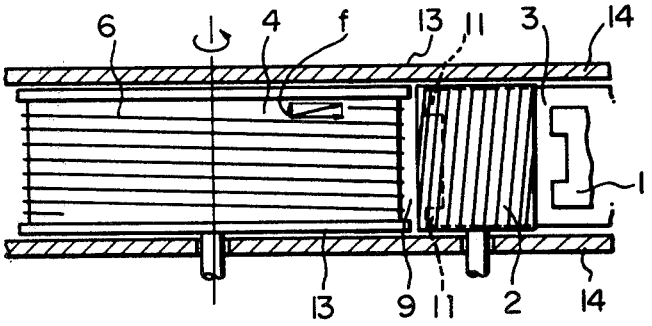
Fig. 3 PRIOR ART
FIG. 3 is a cross sectional side view of the conventional fiber feeding mechanism illustrated in FIG. 2.

In FIGS. 1, 2 and 3, wherein a conventional open-end spinning frame is illustrated, the flow-in air current A mainly flows through a gap between the presser 3 and a casing 12. Consequently, the flowing region and the amount of air are very limited because the flanged surfaces 13 of the combing roller 4 are positioned at substantially the same heights as the upper and lower surfaces of the feed roller 2 and the presser 3 (see FIG. 3) so that the gaps between the feed roller 2, the presser 3 and the upper and lower flat side plates 14 are very small, and as a result, the air flow which passes by the feed roller 2 and the presser 3 into the combing region 9 does not occur easily.

In the present invention, the feeding mechanism is provided with a passage for flowing air current which prevents the accumulation of fibers or flies around the fiber feeding mechanism at the widthwise side region thereof.

Figure 4:
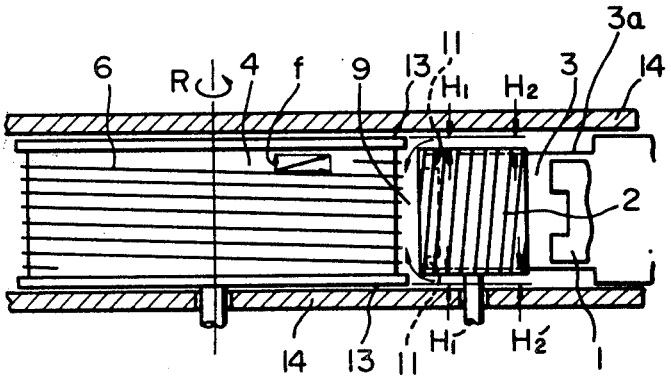
FIG. 4 is a cross sectional side view of a device according to the present invention.
Figure 5:
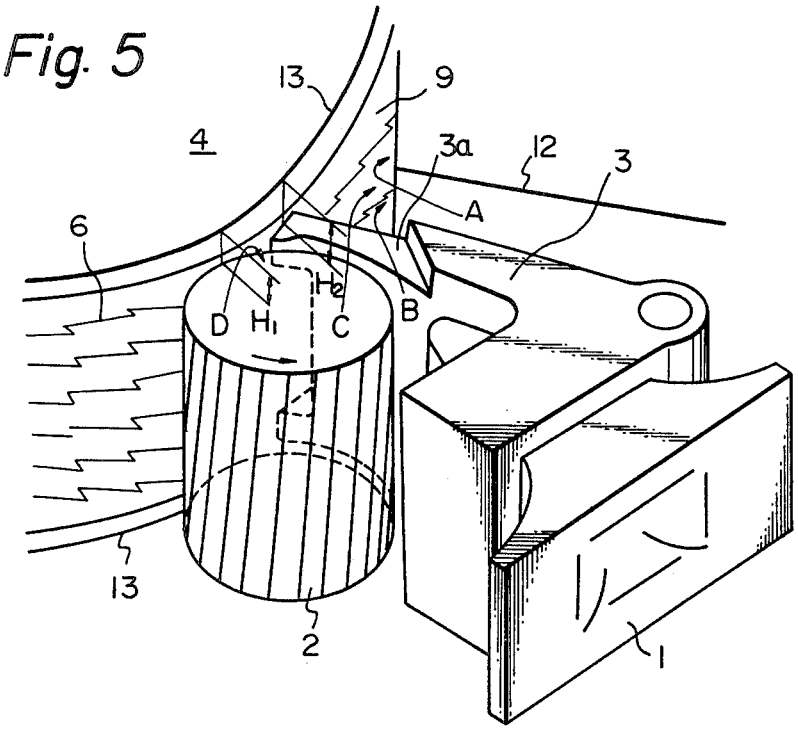
FIG. 5 is a perspective view of the device illustrated in FIG. 4.
Figure 6:
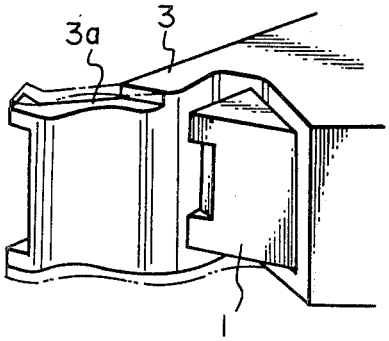
FIG. 6 is a perspective view of a presser utilized in the device illustrated in FIG. 4.

In a first embodiment illustrated in FIGS. 4, 5 and 6, the widths of the feed roller 2 and the presser 3 are shortened so that both the upper and lower surfaces of both the feed roller 2 and the presser 3 are positioned within the flanged surfaces of the combing roller 4, and as a result, large gaps are formed between them and the upper and lower flat side plates 14. Because of this construction, as illustrated in FIG. 5, the air current flowing into the combing region 9 comprises a flow-in air current A which is similar to that in a conventional appparatus, a flow-in air current B which passes by the presser 3 only, a flow-in air current C which passes by both the feed roller 2 and the presser 3, and a flow-in air current D which passes by the feed roller 2 only. Thus, a large amount of air currents flow in various regions. Accordingly, flies around the fiber feeding mechanism do not accumulate there but are conveyed to the combing region 9 under the influence of the flow-in air currents A through D which assist the combing of the flies. As illustrated in FIG. 4, it is preferable that the distance $H_2$ or $H_2'$ between the flanged surface 13 and the upper or lower side surface of the presser 3 be equal to or larger than the distance $H_1$ or $H_1'$ between the flanged surface 13 and the upper or lower side surface of the feed roller 2. This is because the flow resistance of the flow-in air currents, especially the flow-in air currents B and C, at the side surfaces of the presser 3 is decreased.

To lower the side surface of the presser 3, the front side 3*a* of the presser 3 may be chamfered a constant depth, as illustrated in FIGS. 4, 5 and 6, thereby forming a widthwise step. Although it is not illustrated, it is also possible that the front side of the presser be obliquely chamfered.

Figure 7:
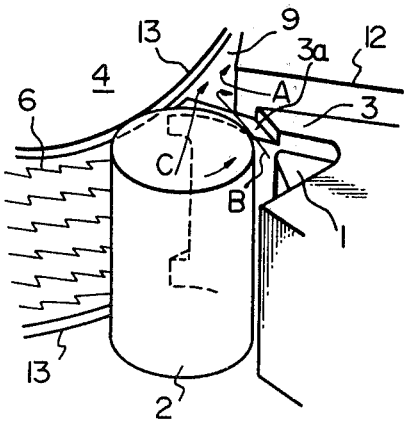
FIG. 7 is a perspective view of a device according to the present invention.

FIG. 7 illustrates another embodiment wherein only the front side surface 3*a* of the presser 3 is chamfered a constant depth so that the flow-in air currents A, B and C flow into the combing region 9. However, the amount of the flow-in air current C in this embodiment is not as large as that in the first embodiment.

Figure 8:
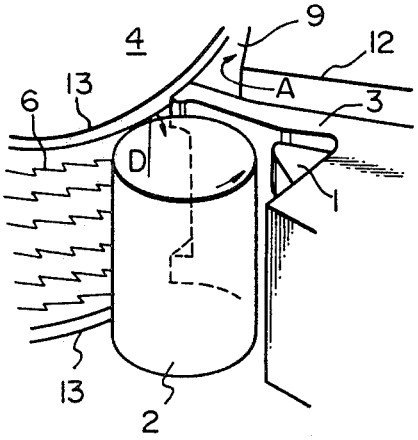
FIG. 8 is a perspective view of a device according to the present invention.

FIG. 8 illustrates a further embodiment wherein the width of the feed roller 2 is made smaller than that of the combing roller 4. In this embodiment, the flow-in air currents B and C are not easily produced because the presser 3 is not chamfered. However, the flow-in air currents A and D are produced, and, the flow-in air current D especially facilitates the scattering movement of fibers or flies which have a tendency to accumulate at the narrow space between the presser 3 and the feed roller 2.

Figure 9:
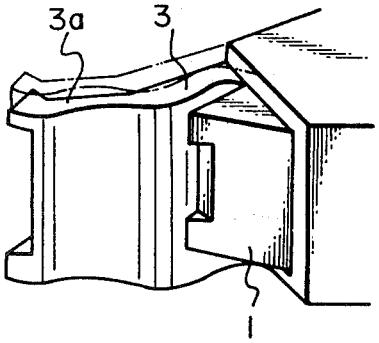
FIG. 9 is a perspective view of a presser utilized in a device according to the present invention.

Referring to FIG. 4, in general, a metallic wire 6 of the combing roller 4 is helically wound around the combing roller 4. If the metallic wire 6 is wound in a left-handed thread manner and the combing roller 4 is rotated in the direction of the arrow R, the fibers combed by the combing roller 4 are passed upwards because of the axial force f caused by the rotation of the inclined metallic wire 6. As a result, the combed fibers have the tendency to pass by the upper portion of the combing roller 4, and there is also the tendency for the flies to gather at the upper portion. In this case, the gaps $H_1'$ and $H_2'$ located at the lower portion of the fiber feeding mechanism are of no use for preventing the accumulation of fibers or flies. Taking into consideration the above situation, in FIG. 9, only the upper side surface of the presser 3 is chamfered. The original shape of the upper side is illustrated by the two dot-dash line. If the metallic wire 6 (FIG. 4) is wound in a right-handed thread manner, it is sufficient that the air flow passage of the present invention be formed only at the lower portion of the fiber feeding mechanism.

In the conventional open-end spinning frame of FIG. 3 the presser 3 has a pair of projections 11, as illustrated by the broken line, at both ends of the front of the presser 3 which encircle the combed fibers so that the fibers gathered because of the axial force are stopped. However, the flies may become clogged in such projections. More specifically, as the combing roller 4 rotates at high speed, flies, especially those released from the return passage 8, (see FIG. 1) are discharged to the fiber feeding mechanism, and they accumulate on the projections 11 (FIG. 3) extending towards the combing roller 4. As a result, the function of the presser 3 is less efficient, or a yarn breakage or degradation of the obtained yarn quality occurs when the clogged flies are again transferred into the spinning rotor 5. In the embodiment illustrated in FIGS. 10 and 11, only one projection 11 is formed at one end of the front **3*b* of the presser 3 and is located at a position opposite to the position to which the inclined metallic wire 6 is directed with respect to the rotating movement of the combing roller 4. A space 15 is formed between the front 3*b* of the presser 3, the projection 11 and the combing roller 4, and through the space 15, the flow-in air current F (FIG. 11**) flows so that the accumulation of flies is prevented.

Figure 10:
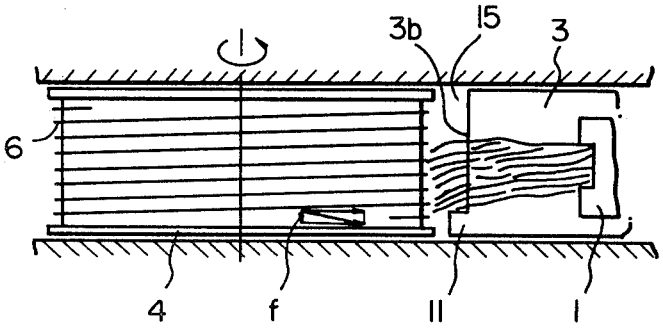
FIG. 10 is a cross sectional side view of a device according to the present invention.
Figure 12:
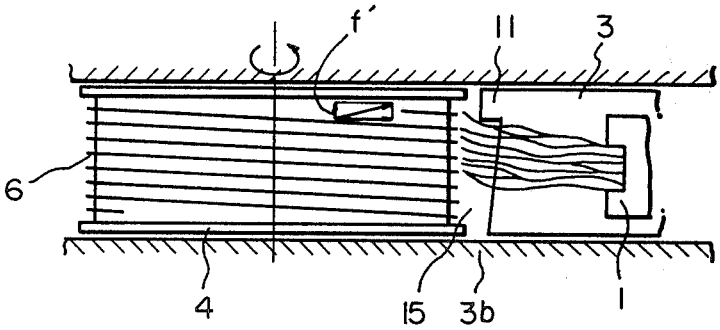
FIG. 12 is a cross sectional view of a device according to the present invention.

If the winding direction of the metallic wire 6 is opposite to that illustrated in FIG. 10, it is necessary that the projection 11 be located in the position as illustrated in FIG. 12.

Figure 11:
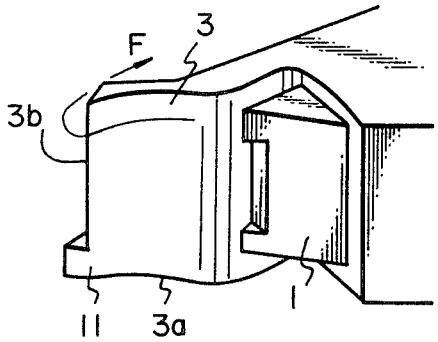
FIG. 11 is a perspective view of a presser utilized in the device illustrated in FIG. 10.
Figure 13:
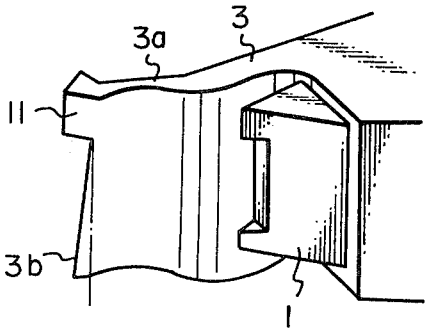
FIG. 13 is a perspective view of the presser utilized in the device illustrated in FIG. 12.

In FIGS. 10 and 11, the front **3*b* of the presser 3 is formed so as to be perpendicular to the side 3*a* of the presser 3. However, the front 3*b* of the presser 3 may be slightly inclined forward as illustrated in FIGS. 12 and 13**.

In some cases, the embodiment illustrated in any one of the embodiments in FIGS. 4 through 9 may be combined with that illustrated in FIGS. 10 and 11 or FIGS. 12 and 13.

The device of the present invention is simple in construction. However, because of one or more air current flowing passages the accumulation of the fibers or flies can be remarkably prevented by one or more flow-in air currents through one or more of the passages. Because fibers or flies are not accumulated on the presser, the function of the presser is more efficient. The yarn breakage and the degradation of the spun yarn do not occur because the flies are not solidified and because the solidified flies do not enter into the spinning rotor. Also, according to the present invention, an additional advantage is that the flow-in air current facilitates the combing operation.

What we claim is:

1. An open-end spinning frame comprising a fiber feeding mechanism including a feed roller having first and second end surfaces and a presser urged towards said feed roller, a combing roller having first and second end surfaces for combing fibers fed from said feed roller, a rotor for spinning said fibers delivered from said combing roller respectively, and first and second planar side plates disposed adjacent the first and second end surfaces, the width of said feed roller between the end surfaces thereof being less than the width of said combing roller between the end surfaces thereof, whereby said feeding mechanism is provided at a widthwise side region thereof with a passage for flowing air current which prevents accumulation of fibers therearound, said passage having an enlarged portion adjacent the end surfaces of said feed roller.

2. An open-end spinning frame according to claim 1, wherein said presser is chamfered at a front side thereof so that the front width of said presser is smaller than that of said combing roller and the chamfered portion of the presser defines said air current flowing passage.

3. An open-end spinning frame according to claim 1, wherein said presser is chamfered at a front side thereof so that a gap is formed between at least one of said end surfaces of said combing roller and said chamfered front side of said presser, said gap being at least equal in width to the distance between said end surface of said combing roller and the adjacent end surface of said feed roller.

4. An open-end spinning frame according to claim 1, wherein said presser has one projection at one end of the front thereof and the front end of said projection is located near said combing roller, so that a space is formed between said front of said presser, said projection and said combing roller, which space serves as said air current flowing passage.

5. An open-end spinning frame according to claim 4, wherein said combing roller has a metallic wire helically wound therearound so that said metallic wire is inclined in one direction, and said projection is formed at an end opposite to the end to which said inclined metallic wire is directed while said combing roller rotates.

6. An open-end spinning frame according to claim 5, wherein said front of said presser is slightly inclined towards said feed roller.

* * * * *

UNITED STATES PATENT AND TRADEMARK OFFICE

CERTIFICATE OF CORRECTION

PATENT NO. : 4,254,612

DATED : March 10, 1981

INVENTOR(S) : Noriaki Miyamoto; Massao Shiraki

It is certified that error appears in the above—identified patent and that said Letters Patent is hereby corrected as shown below:

Column 1, line 52, delete "a" (first occurrence)

Column 2, line 15, change "flowing" to --flow--.

Column 4, line 22, change "of" to --to--.

Signed and Sealed this

*Thirteenth* Day of *October 1981*

[SEAL]

*Attest:*

GERALD J. MOSSINGHOFF

*Attesting Officer*

*Commissioner of Patents and Trademarks*